US005626467A

United States Patent [19]

Cantley

[11] Patent Number: 5,626,467

[45] Date of Patent: May 6, 1997

[54] MODULAR PUMP

[75] Inventor: George A. Cantley, Akron, Ohio

[73] Assignee: Teledyne Industries, Inc., Los Angeles, Calif.

[21] Appl. No.: 627,503

[22] Filed: Apr. 4, 1996

[51] Int. Cl.[6] ..... F04B 39/00

[52] U.S. Cl. ..... 417/312; 417/397; 417/399

[58] Field of Search ..... 417/312, 360, 417/397, 399

[56] References Cited

U.S. PATENT DOCUMENTS

| | | | |
|---|---|---|---|
| 2,751,889 | 6/1956 | Mohler . | |
| 2,751,891 | 6/1956 | Mohler . | |
| 2,826,149 | 3/1958 | Wrigley . | |
| 3,174,409 | 3/1965 | Hill . | |
| 3,253,775 | 5/1966 | Jackson | 417/397 |
| 3,272,081 | 9/1966 | Vedder et al. . | |
| 3,478,958 | 11/1969 | Hinck et al. | 417/312 X |
| 3,489,100 | 1/1970 | Hill . | |
| 3,794,448 | 2/1974 | Albertson . | |
| 3,963,383 | 6/1976 | Hill . | |
| 4,104,008 | 8/1978 | Hoffmann et al. . | |
| 4,123,204 | 10/1978 | Scholle . | |
| 4,359,085 | 11/1982 | Mueller | 417/312 X |
| 4,373,874 | 2/1983 | Phillips | 417/397 |
| 4,405,292 | 9/1983 | Bixby, Jr. et al. . | |
| 4,441,862 | 4/1984 | Vogel . | |
| 4,540,349 | 9/1985 | Du . | |
| 4,684,332 | 8/1987 | Hartley et al. . | |
| 4,693,271 | 9/1987 | Hargrove et al. . | |
| 4,730,991 | 3/1988 | Handfield . | |
| 4,971,531 | 11/1990 | Aikioniemi . | |
| 4,981,418 | 1/1991 | Kingsford et al. . | |
| 5,094,596 | 3/1992 | Erwin et al. . | |
| 5,151,018 | 9/1992 | Clendenin et al. | 417/312 |
| 5,169,296 | 12/1992 | Wilden . | |
| 5,326,234 | 7/1994 | Versaw et al. . | |
| 5,415,531 | 5/1995 | Cavanaugh . | |

*Primary Examiner*—Richard E. Gluck
*Attorney, Agent, or Firm*—Pearne, Gordon, McCoy & Granger

[57] ABSTRACT

A modular air-driven pump includes an air motor and various sized fluid pumps which are interchangeably mountable to the air motor. The air motor includes first and second bulkheads, a motor cylinder held between the first and second bulkheads, and a motor piston within the motor cylinder. An air control system supplies air from an air inlet to the motor cylinder alternately on each side of the motor piston while venting the motor cylinder on an opposite side of the motor piston to an air outlet to reciprocate the motor piston. The first bulkhead has an opening substantially coaxial with the motor cylinder and first and second cylindrically-shaped and coaxial recesses at an outward side of the first bulkhead which surround the opening The second recess has larger diameter and a smaller depth than the first recess so that they are stair stepped. Each of the first and second fluid pumps include an end block, a pump cylinder held between the end block and the first bulkhead coaxial with the motor cylinder and within one of the recesses, and a pump piston within said pump cylinder. The pump piston is removably connected to the motor piston through the opening for reciprocable movement of the pump piston with the motor piston. The pump cylinder of the first fluid pump is sized and shaped for cooperating with the first recess of the first bulkhead and the pump cylinder of the second fluid pump is sized and shaped for cooperating with the second recess of the first bulkhead. An air-motor enclosure surrounds the air motor and a fluid-pump enclosure surrounds the fluid pump. The fluid-pump enclosure forms an exhaust plenum in fluid communication with the air outlet and has an exhaust outlet to reduce noise created by exhausting air.

20 Claims, 4 Drawing Sheets

MODULAR PUMP

BACKGROUND OF THE INVENTION

1. Field of the Invention

The present invention relates to fluid pumps assemblies and, more particularly, to modular pump assemblies having a fluid pump and a fluid activated motor for driving the fluid pump.

2. Description of Related Art

Various fluid pump systems have been developed which have one or two pump assemblies driven by a fluid activated motor such as an air motor. Some of these pump systems are produced in a modular design that accommodates manufacture of pump assemblies that provide different pumping performance parameters such as, for example, different pumping pressures, different volumes, or different flow rates. These modular designs, however, may not facilitate rapid assembly and disassembly of the pump system for interchanging pump assemblies, inspection, repair, or replacement of parts with little downtime or loss of production. Additionally, these modular designs may not allow pump assemblies having a relatively wide range of performance parameters to be used with a common air motor.

The air motor typically uses compressed air during a portion of the pumping cycle and exhausts the compressed air to atmospheric pressure. This rapid expansion of the compressed air to atmospheric pressure can be very noisy. Therefore, some air driven pumps have utilized various types of external mufflers to reduce the amount of noise caused by the exhausted air. These external mufflers, however, add to the overall complexity of the pumps by adding additional parts which can contribute to greater manufacturing costs and/or greater repair downtime for the pumps.

Additionally, if the air contains moisture or water vapor which is not removed before the air enters the pump, the cooling effect of polytropic adiabatic expansion of the air as the air is exhausted from the pump can cause the water vapor to freeze. The moisture tends to build up in and block the exhaust passage when it freezes and can eventually completely shut off the exhaust passage and prevent operation of the pump. Therefore, some air driven pumps have utilized various types of air mixing or moving elements to reduce the amount of ice formation caused by the exhausted air. These types of ice reducing mechanisms, however, add to the overall complexity of the pumps by adding additional parts and/or flow paths which can contribute to greater manufacturing costs and/or greater repair downtime for the pumps.

Accordingly, there is a need for an improved fluid driven pump which has a rapidly assembled and disassembled modular design for ease of maintenance and interchangability and which has a common air motor for driving pump assemblies having a relatively wide range of performance parameters. Additionally, there is a need for an improved fluid driven pump which is relatively easy to manufacture and maintain, which provides noise reduction in a relatively simple manner, and which provides reduced blockage due to freezing exhaust, in a relatively simple manner.

SUMMARY OF THE INVENTION

The present invention provides a modular air-driven pump including an air motor and first and second fluid pumps interchangeably mountable to the air motor. Therefore, the same air motor can selectively be used with each of the first and second pumps which are of different sizes. The air motor includes first and second bulkheads, a motor cylinder held between the first and second bulkheads, and a motor piston within the motor cylinder. An air control system supplies air from an air inlet to the motor cylinder alternately on each side of the motor piston while venting the motor cylinder on an opposite side of the motor piston to an air outlet to reciprocate the motor piston in the motor cylinder. The first bulkhead has an opening substantially coaxial with the motor cylinder and first and second stepped recesses at an outward side of the first bulkhead which surround the opening.

Each of the first and second fluid pumps include an end block, a pump cylinder held between the end block and the first bulkhead substantially coaxial with the motor cylinder, and a pump piston within the pump cylinder. The pump piston is removably connected to the motor piston through the opening for reciprocable movement of the pump piston with the motor piston. The pump cylinder of the first fluid pump is sized and shaped for cooperating with the first recess of the first bulkhead, and the pump cylinder of said second fluid pump is sized and shaped for cooperating with the second recess of the first bulkhead.

According to one embodiment, an enclosure substantially surrounds the first and second fluid pumps when mounted to the first bulkhead and a second enclosure substantially surrounds the air motor. The enclosures provide shrouds for the air motor and the fluid pumps.

According to another embodiment, an enclosure forms an exhaust plenum in fluid communication with the air outlet and having an exhaust outlet. The exhaust plenum reduces the noise-level of the exhausting air. Preferably, the fluid motors are mounted within the enclosure so that the exhaust air cools the relatively hot fluid pumps and the fluid pumps warm the exhaust air to reduce freezing.

BRIEF DESCRIPTION OF THE DRAWINGS

These and further features of the present invention will be apparent with reference to the following description and drawings, wherein.

DETAILED DESCRIPTION OF THE PREFERRED EMBODIMENT

Figure 1:
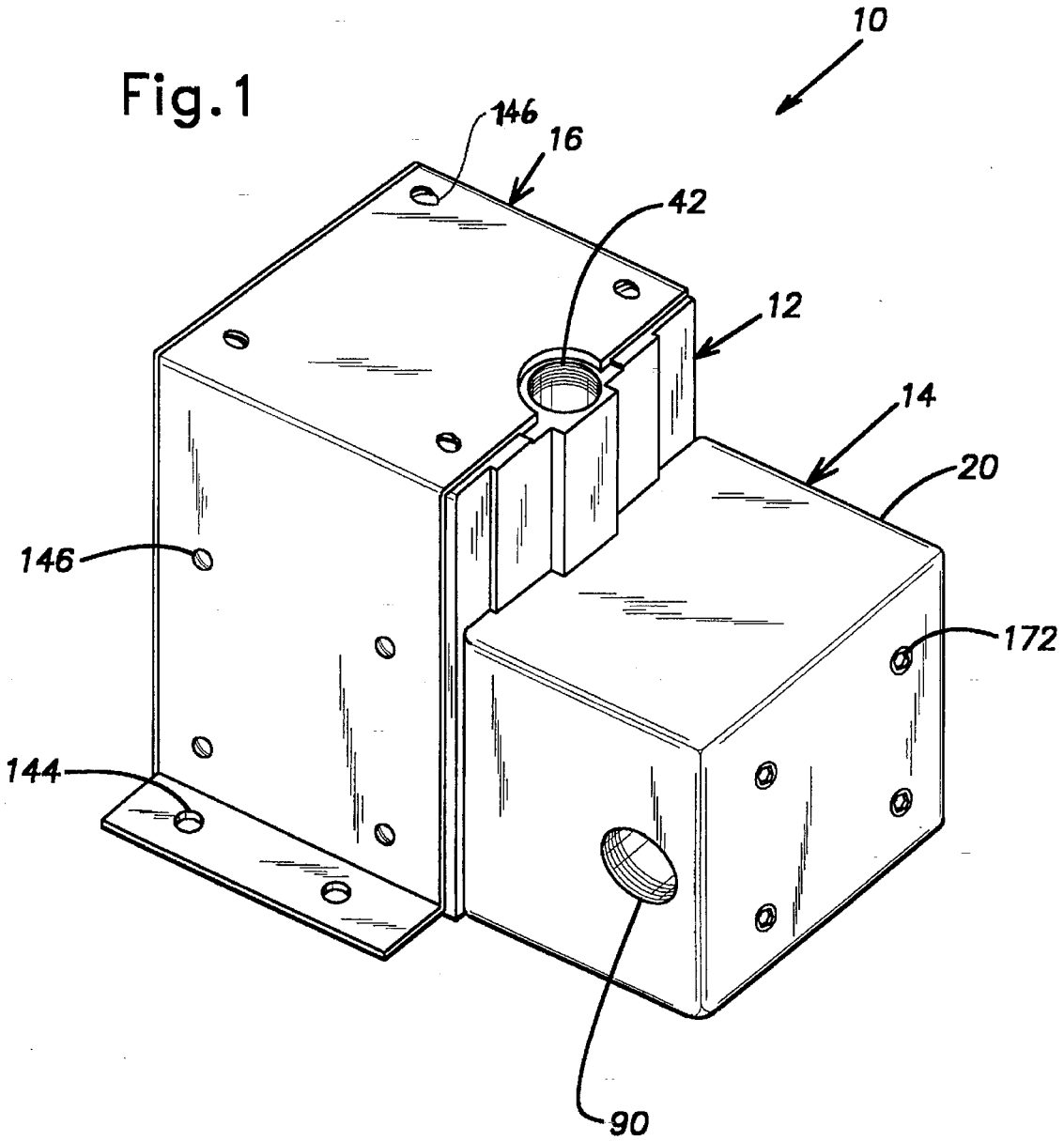
FIG. 1 is a perspective view of a modular pump according to the invention.
Figure 2:
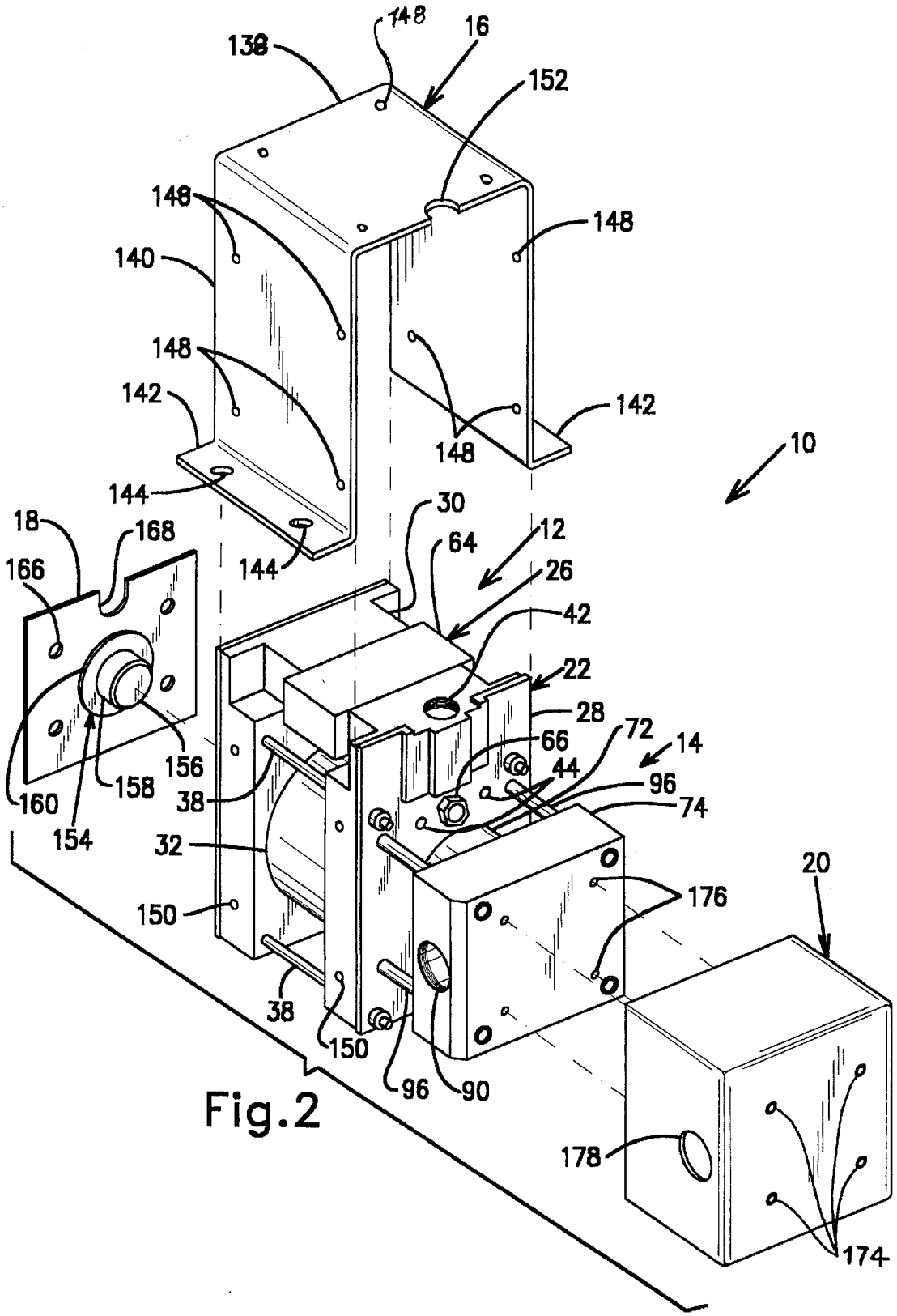
FIG. 2 is a partially exploded view of the modular pump of FIG. 1.

FIGS. 1 and 2 illustrate an air-driven high-pressure hydraulic pump 10 according to the present invention which includes an air-motor module 12, a liquid-pump module 14, an air-motor cover or enclosure 16, an end cover 18, and a liquid-pump cover or enclosure 20. The air-motor enclosure 16 and the liquid-pump enclosure 20 provide shrouds for the pressurized cylinders of the air-motor module 12 and the liquid-pump module 14.

Figure 3:
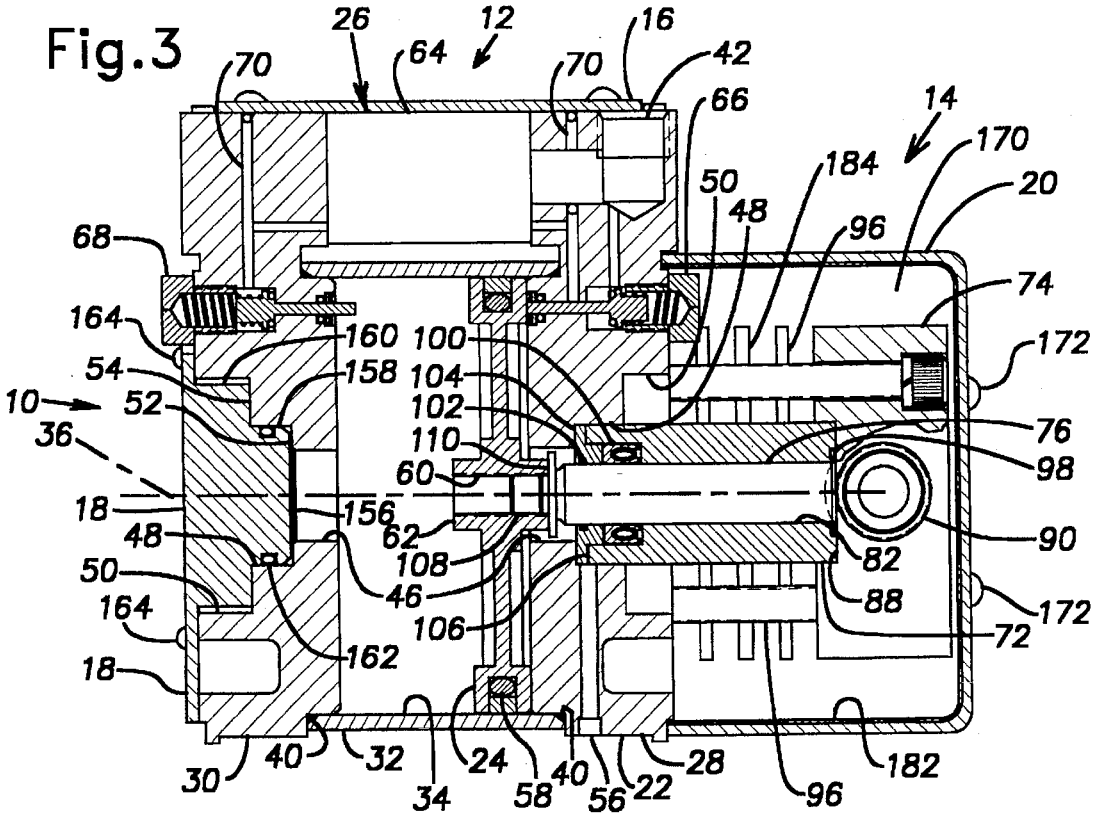
FIG. 3 is an enlarged elevational view, in cross-section, of the modular pump of FIG. 1.

As best shown in FIGS. 2 and 3, the air-motor module 12 includes a cylinder assembly 22, a motor piston 24, and an air control system 26. The cylinder assembly 22 includes first and second bulkheads 28, 30 and a hollow tube 32 clamped therebetween to form a cylindrically-shaped motor-piston chamber or cylinder 34 having a horizontal axis 36. The bulkheads 28, 30 are rectangularly-shaped and held together by threaded fasteners 38 which longitudinally extend through the four corners of the bulkheads 28, 30. Suitable means 40 for sealing the tube 32 to the first and second bulkheads 28, 30 are provided such as, for example, O-rings. The first bulkhead 28 has an air inlet 42 which opens at a top surface of the first bulkhead 28 and at least one air outlet 44 which opens at an outward end surface of the first bulkhead 28. The air inlet 42 is preferably suitably threaded for mating with a source of compressed air.

Figure 4A:
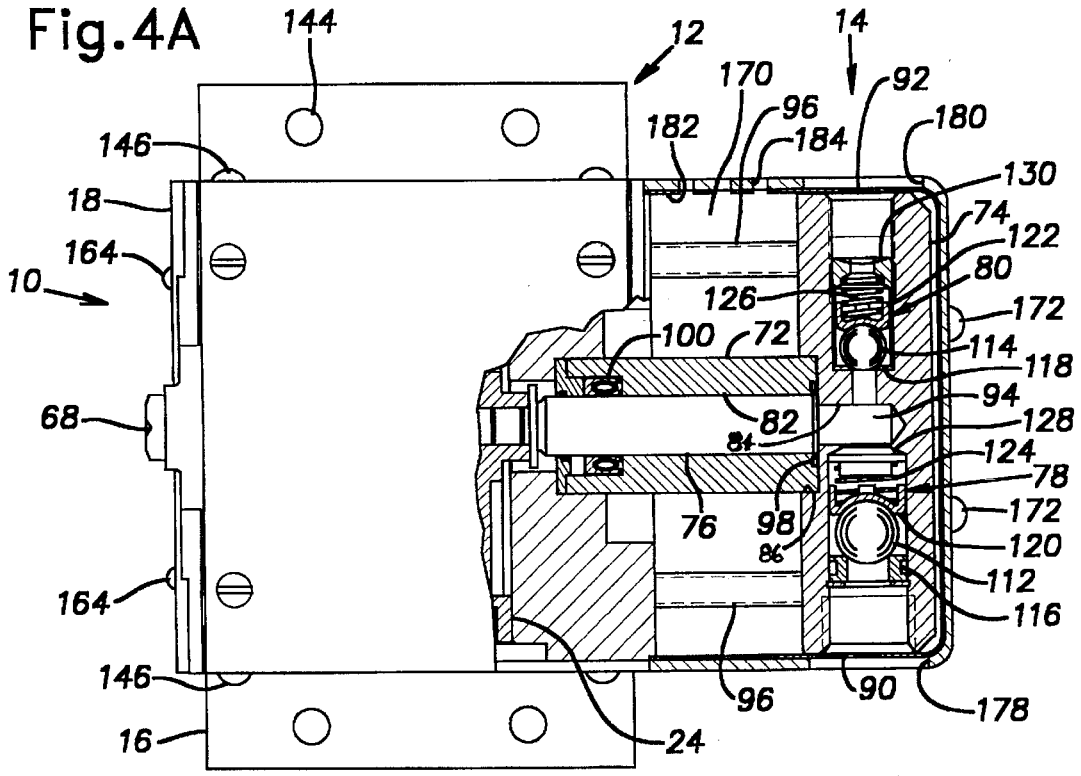
FIG. 4A is an enlarged plan view, in partial cross-section, of the modular pump of FIG. 1.

Each of the bulkheads 28, 30 have an opening 46 extending therethrough and coaxial with the cylinder 34. First and second stepped recesses or counterbores 48, 50 having different diameters are formed on the outward end surfaces of the bulkheads 28, 30. The counterbores 48, 50 are coaxial with each other and the opening 46 and form first and second abutment surfaces 52, 54 which are substantially perpendicular to the axis 36 of the opening 46. The second recess 50 is latterly larger, that is, has a larger outer diameter than the first recess 48, and is longitudinally smaller, that is, has a smaller depth than the first recess 48. Arranged in this manner the recess 48, 50 are generally stair-stepped. As best shown in FIG. 4A, a vent passage hole 56 is provided which extends from a peripheral surface of the first counterbore 48 to a bottom surface of the bulkhead 28, 30.

The motor piston 24 is located within the cylinder 34 for horizontal movement therein between the bulkheads 28, 30. The motor piston 24 is provided with suitable means 58 for sealing the periphery of the motor piston 24 with the peripheral inner surface of the cylinder 34 such as, for example, an O-ring. An internally threaded central opening 60 is formed in the motor piston 24 which is substantially coaxial with the cylinder 34 and extends through the motor piston 24 to open on each side of the motor piston 24. An abutment surface 62 encircles each end of the opening 60 which is substantially perpendicular to the axis 36 of the cylinder 34.

The air control system 26 includes an air control valve 64 and first and second of pilot valves 66, 68. The air control valve 64 is mounted between the first and second bulkheads 28, 30 above the cylinder 34. The pilot valves 66, 68 extend through the first and second bulkheads 28, 30 near the top of the cylinder 34 and into the ends of the cylinder 34. Air passages 70 are formed in the first and second bulkheads 28, 30 to provide suitable fluid communication among the air inlet 42, the air control valve 64, the pilot valves 66, 68, the cylinder 34, and the air outlet 44.

The air control valve 64 supplies compressed air from the air inlet 42 to the cylinder 34 on a first side of the motor piston 24 while the cylinder 34 on the second side of the motor piston 24 is being vented to the air outlet 44 to cause the motor piston 24 to horizontally move toward the second pilot valve 68. The motor piston 24 actuates the second pilot valve 68 near the end of its stroke of movement to cause the air control valve 64 to supply air to the cylinder 34 on the second side of the motor piston 24 while venting the cylinder 34 on the first side of the motor piston 24 to cause the motor piston 24 to horizontally move in the opposite direction toward the first pilot valve 66. The motor piston 24 actuates the first pilot valve 66 near the end of its stroke of movement which again reverses the direction of the motor piston 24. In this manner, the motor piston 24 horizontally reciprocates back and forth within the cylinder 34.

As best shown in FIGS. 2, 3, and 4A, the liquid-pump module 14 includes a cylinder block 72, and end block 74, a pump piston 76, and a pair of check valves 78, 80. The cylinder block 72 is generally cylindrically shaped and forms a longitudinally extending pump chamber or cylinder 82 having a horizontal axis 36. The cylinder block 72 has an outer diameter sized to cooperate with the first counterbore 48 in the first bulkhead 28 of the air-motor module 12. It is noted that the cylinder block 72 could have other cross-sectional shapes such as, for example, rectangular or triangular, however, the recesses 48, 50 in the bulkheads 28, 30 would require similar shapes for cooperating with and receiving the cylinder block 72.

An inward end of the end block 74 is provided with a horizontally extending blind hole 84 and a counterbore 86 substantially coaxial with the blind hole 84 and having an outer diameter sized for receiving the outer diameter of the cylinder block 72. The counterbore 86 forms an inward facing abutment surface 88 which is substantially perpendicular to the axis 36 of the blind hole 84. Liquid inlet and outlet ports 90, 92 are formed in the end block 74 which open at the opposite side surfaces of the end block 74 and extend to the blind hole 84. The inlet port 90 is of a larger diameter than the outlet port 92 to facilitate the flow of liquids. The inlet and outlet ports 90, 92 are aligned with one another, substantially coaxial, and diametrically opposed across the pumping chamber 94 formed by the blind hole 84 and the cylinder 82. An outer portion of the inlet and outlet ports 90, 92 is suitably threaded for connecting liquid input and output lines.

The end block 74 is rectangularly-shaped and attached to the first bulkhead 28 with threaded fasteners longitudinally extending through the four corners of the end block 74. The cylinder block 72 is within the counterbores 48, 86 of the first bulkhead 28 and the end block 74 and is thereby clamped therebetween with the pump cylinder 82 substantially coaxial with the motor cylinder 34. Suitable means 98 for sealing the cylinder block 72 to the end block 74 are provided such as, for example, an O-ring.

The pump piston 76 is located within the cylinder 82 for horizontal movement therein and has an outer diameter smaller than outer diameter of the motor piston 24. A high-pressure sealing member 100 (suitable for withstanding pressures of the liquid in the pumping chamber 94) and a low-pressure sealing member 102 (relative to the high pressure sealing member 100 and suitable for withstanding pressures of the air in the cylinder 82 of the air-motor module 12) are provided to seal the periphery of the pump piston 72 with the peripheral inner surface of the cylinder 82. The high-pressure sealing member 100 is provided within an enlarged diameter portion of the cylinder 82 at the inward end of the cylinder block 72 and at a position outward of the vent hole 56 in the first bulkhead 28 of the air-motor module 12. An end cap 104 is attached to the inward end of the cylinder block to close the enlarged diameter portion of the cylinder 82 and to retain the high-pressure sealing member 100 in position. The low-pressure sealing member 102 is provided at the end cap 104 at a position inward of the vent hole 56 in the first bulkhead 28 of the air motor module 12. The end cap 104 has a vent passage 106 which provides fluid communication between the vent hole 56 and a space intermediate to the high and low pressure sealing members 100, 102. The low-pressure sealing member 102 acts as a back-up to the high-pressure sealing member 100 for controlled venting, through the vent hole 56, of any liquid leaking past the high pressure seal 100 and thereby preventing misting of air in the air-motor module 12 by leaking liquid from the liquid-pump module. The venting of the leaking liquid through the vent hole 56 also provides ready detection of the leakage past the high pressure seal member 100 and creates an economical separated pump.

The inward end of the pump piston 76 has an externally threaded stem 108 which is substantially coaxial with the motor cylinder 34 and is sized for removably mating with the threaded opening 60 of the motor piston 24. An inward facing abutment surface 110 is provided on an outward end of the stem 108 and is substantially perpendicular to the axis 36 of the cylinder 34. The abutment surface 110 is sized and positioned to engage the outward facing abutment surface 62 of the motor piston 24 when the stem 108 is fully engaged in the threaded opening 60. With the pump piston 76 coupled to the motor piston 24, the pump piston 72 horizontally moves with the reciprocating motor piston 24.

The inlet check valve 78 is located in the inlet port 90 and the outlet check valve 80 is located in the outlet port 92. Each check valve 78, 80 preferably includes a ball 112, 114 forming the movable valve element, a wear resistant seat 116, 118 for the ball 112, 114, a ball retainer guide 120, 122 which guides the ball relative to its seat and prevents the ball from seating on the inlet side of the inlet port 90 or the outlet side of the outlet port 92, a spring member 124, 126 which urges the ball 112, 114 to the seat 116, 118, and a base member 128, 130 which holds the spring member 124, 126 in position. The guides 120, 122 each have cut away portions in their sidewalls to facilitate passage of the liquid. The balls 112, 114 are seated and unseated by negative and positive pressure generated by the pump piston 76 in the pumping chamber 94.

As the pump piston 76 is moved inwardly on its suction stroke by the motor piston 24, the outlet ball 114 will seat on its seat 118 and the inlet ball 112 will be forced inwardly off its seat 116 and liquid will be sucked from a supply through inlet port 90 and the inlet check valve 78 to the pumping chamber 94. The outlet check valve 80 prevents return of the liquid through the outlet port 92. When the pump piston 76 reverses its direction and is moved outwardly on its pressure stroke by the motor piston 24, the inlet ball 112 is seated on its seat 116 and the outlet ball 114 is forced outwardly off its seat 118 by liquid being pushed forward under pressure by the pump piston 76, and the liquid is delivered under pressure through the outlet port 92 to a point of use. The inlet check valve 78 prevents passage of the liquid out the inlet port 90. As the pump piston 76 continues to reciprocate, liquid is pulled into and pushed out of the pumping chamber 94 and essentially passes diametrically through the pumping chamber 94 from the inlet port 90 to the outlet port 92.

The modular design of the pump 10 enables variously sized liquid-pump modules 14 to be interchangeably mounted to the same air-motor module 12. It is noted that the pump piston 76 is removably coupled to the motor piston 24, and the liquid-pump module 14 is removably coupled to the air-motor module 12 so that a variety of liquid-pump modules 14 can be easily used with a common air-motor module 12. A large size range of liquid-pump modules 14 can be utilized with the same air-motor module 12 because the bulkheads 28, 30 are provided with the concentric counterbores 48, 50 which receive cylinder blocks 72 having different outer diameters. The different outer diameters enable the efficient use of pump pistons 76 having different drive areas.

Figure 4B:
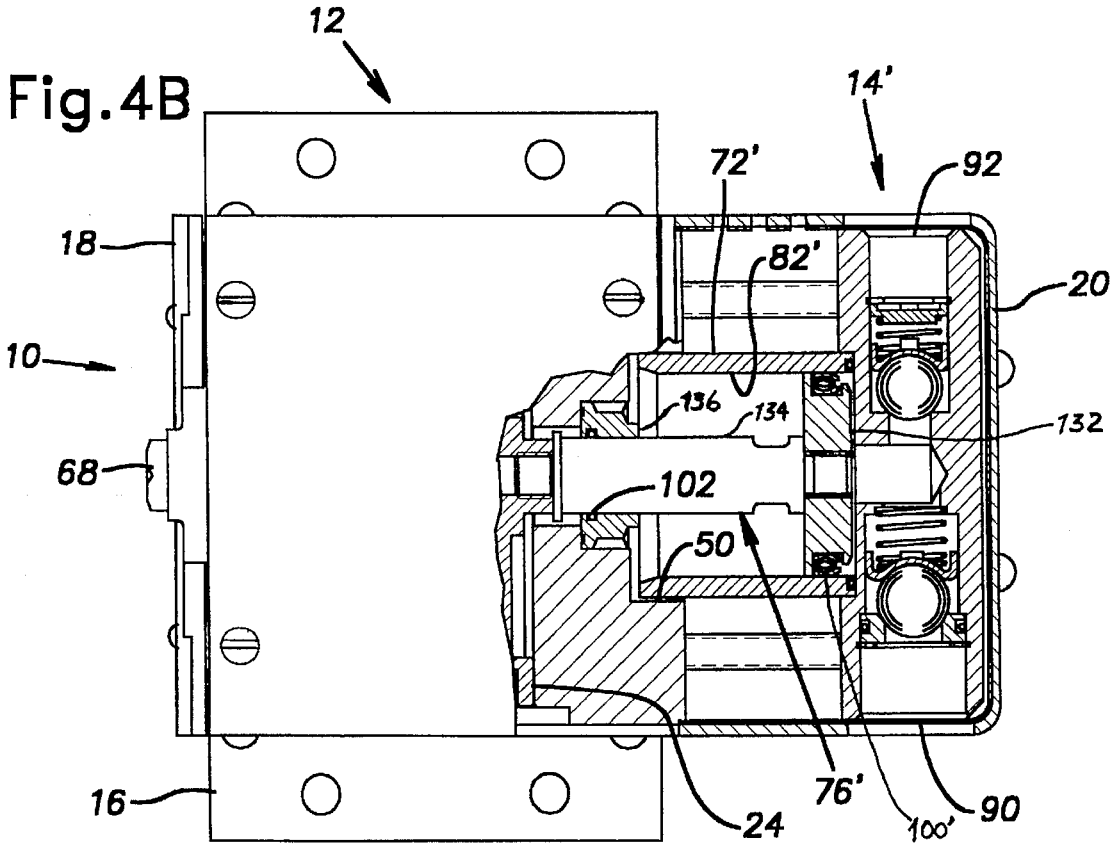
FIG. 4B is a plan view, in partial cross-section, similar to FIG. 4A but with another liquid-pump module.
Figure 4C:
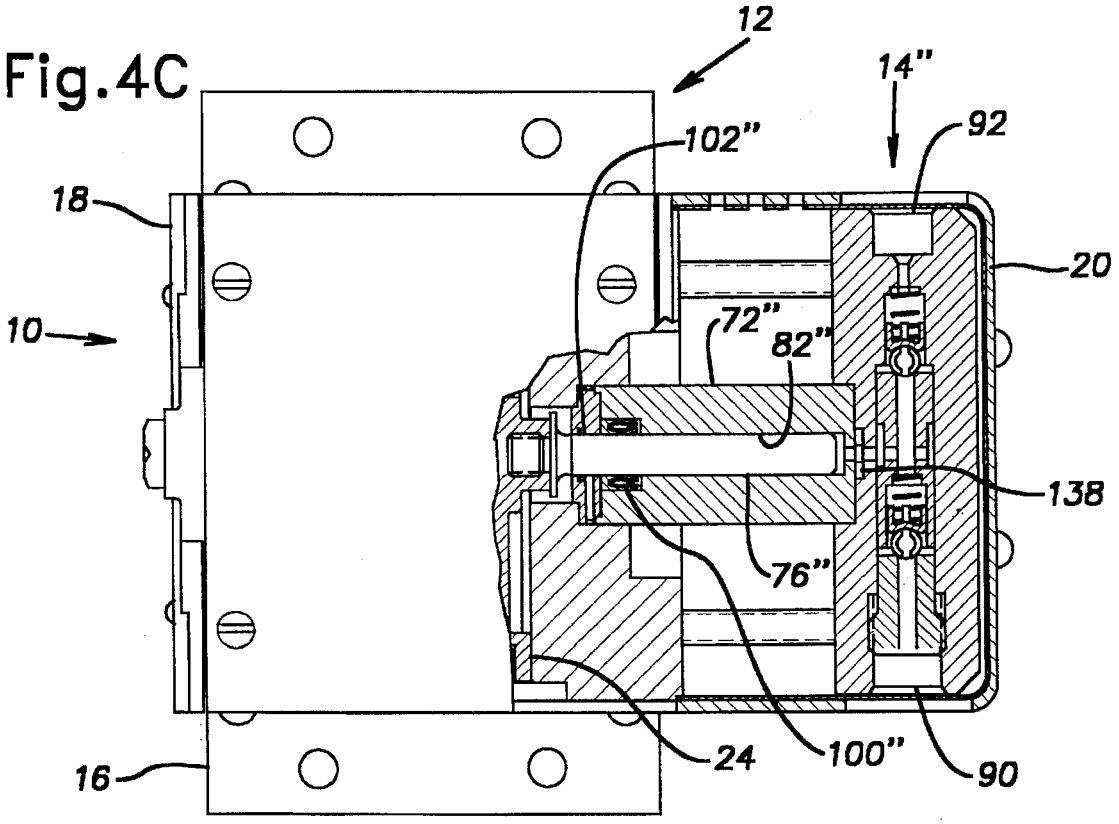
FIG. 4C is a plan view, in partial, cross-section, similar to FIG. 4A and 4B but with yet another liquid-pump module.

By providing pump pistons 76 with different drive areas, a number of different outlet pressures and rates of flow can be provided. FIGS. 4A, 4B, and 4C, illustrate three configurations of the liquid-pump modules 14, 14' 14" which can be utilized to obtain the different drive areas. The liquid-pump modules are otherwise as described above. The first liquid-pump module 14 (FIG. 4A) has been found suitable for various pump piston drive areas to obtain pressure ratios of about 30:1 and about 60:1, where the motor piston 24 has a diameter of about 4 inches. Therefore, a maximum air pressure of about 100 psi produces maximum liquid output pressures of about 2,000 psi, about 3,000 psi, and about 6,000 psi respectively.

As shown in FIG. 4B, the second liquid-pump module 14' has an increased drive area relative to the first liquid-pump module (FIG. 4A). The cylinder block 72' has an increased outer diameter sized for mating with the second counterbore 50 of the first bulkhead 28 of the air-motor module 12. The increased outer diameter of the cylinder block 72' allows an increased diameter cylinder 82'. The pump piston 76' has a body portion 132 which carries the high pressure seal 100' which engages the periphery of the cylinder 82, and a shaft portion 134 which carries the body portion 132. A support member 136 is provided within the first counterbore 48 of the first bulkhead 28 to support the shaft portion 134 and is provided with the low pressure seal 102' which engages the shaft member 132. The configuration of the second liquid pump module 14' has been found has been found suitable for various pump piston drive areas to obtain pressure ratios of about 5:1, about 10:1, and about 20:1 where the motor piston has a diameter of about 4 inches. Therefore, a maximum air pressure of about 100 psi produces maximum liquid output pressures of about 500 psi, and about 1,000 psi respectively.

As shown in FIG. 4C, the third liquid pump module 14" has a decreased drive area relative to the first liquid pump module (FIG. 4A). The cylinder block 72" also has an outer diameter sized for mating with the first counterbore 48 of the first bulkhead 28 of the air-motor module 12, but has a smaller diameter cylinder 82" which is partially closed at its outer end by an end wall having a reduced diameter opening 138 to throttle the flow of liquid therethrough. The third liquid-pump module 14" has been found suitable for various pump piston drive areas to obtain pressure ratios of about 100:1, about 200:1, and about 300:1, where the motor piston has a diameter of about 4 inches. Therefore, a maximum air pressure of about 100 psi produces maximum liquid output pressures of about 10,000 psi, about 20,000 psi, and about 30,000 psi respectively.

The modular design of the pump 10 also enables a liquid-pump module 14 to be mounted to the other end of the air-motor module 12. It is noted that the motor piston 24 is adapted to have a pump piston 76 removably coupled on each end and the second bulkhead 30 is adapted for removably receiving the other liquid-pump module 14 in the same manner as described above for the first bulkhead 28. The reciprocation of the motor piston 28 causes the two pump modules 14 to be operated alternately, i.e. the motor piston 24 drives the pump piston 76 of one liquid-pump module 14 on a forward pressure producing stroke and drives the pump piston 76 of the other liquid-pump module on a rearward suction producing stroke, and then reverses to drive the first pump piston 76 on a suction stroke and the second piston 76 on a pressure stroke. Double ended pumping allows an increased flow rate and/or proportional mixing of two liquids by using liquid-pump modules 14 having different displacement ratios.

As best shown in FIGS. 1 and 2, the air-motor enclosure 16 is generally inverted-U-shaped having a top portion 138 and two side portions 140 perpendicularly extending downward from outer sides of the top portion 138. Perpendicularly extending outward from the bottom edge of each side portion 140 is a mounting flange 142 provided with suitable openings 144 for mounting fasteners. Preferably, the air-motor enclosure 16 is formed from a single sheet of material. The air-motor enclosure 16 is sized to longitudinally extend from the first bulkhead 28 to the second bulkhead 30 and enclose the top and sides of the air-motor module 12. The air-motor enclosure 16 is attached to the air-motor module 12 by threaded fasteners 146 which extend through openings 148 provided in the top and side portions 138, 140 and mate with threaded holes 150 provided in the first and second bulkheads 28, 30. A notch 152 is provided in the top portion 140 to provide adequate clearance for the air inlet 42.

As best shown in FIGS. 2 and 3, the air-motor end cover 18 is a generally planar for mating with and covering the outer end of the second bulkhead 28 and has a plug 154 extending from the inner side for sealing the opening 46 in the second bulkhead 30. It is noted that the end cover 18 is only needed to seal the opening 46 in the second bulkhead 30 when there is not a liquid-pump module 14 attached thereto. The plug 154 has first, second, and third cylindrical portions 156, 158, 160 which are substantially coaxial and have increasing diameters. As best shown in FIG. 3, the first portion 156 has an outer diameter sized to extend into the opening 46 of the second bulkhead 46. The second portion 154 has an outer diameter sized to extend within the first counterbore 48 of the second bulkhead 30 and is substantially equal to the outer diameter of the chamber block 72 of the liquid-pump module 14. The third portion 160 has an outer diameter sized to extend within the second counterbore 50 of the second bulkhead 30. If desired, suitable means 162 for sealing the plug 154 with the second bulkhead 30 such as, for example, an O-ring can be provided. The end cover 18 is attached to the air-motor module 12 by threaded fasteners 164 which extend through openings 166 provided in the end cover 18 and mate with threaded holes provided in the outward end of the second bulkhead 30. A notch 168 is provided in the end cover 18 to provide adequate clearance for the second pilot valve 68.

As best shown in FIGS. 1–4A, the illustrated liquid-pump enclosure 20 is generally a hollow cube having a rearward facing open end. The open end of the enclosure 20 engages the outer end of the first bulkhead 28 of the air-motor module 12 to form an enclosed hollow interior space 170. The liquid-pump module 14 is located within the interior space and is fully surrounded by the liquid-pump enclosure 20 and the first bulkhead 28. The liquid-pump enclosure 20 is attached by threaded fasteners 172 which extend through openings 174 provided in the outward end of the liquid-pump enclosure 20 and mate with threaded holes 176 provided in the outer end of the end block 74 of the liquid-pump module 14. Openings 178 in the lateral sides of the liquid-pump enclosure 20 provide adequate clearance for the liquid inlet and outlet ports 90, 92.

The liquid-pump enclosure 20 also covers the air outlets 44 of the air-motor module 12 which open on the outward end of the first bulkhead 28 so that the interior space 170 is an exhaust air plenum or integral muffler which serves to dampen exhaust noise due to the release of pressurized air from the air-motor module 12. Preferably, the interior surfaces of the liquid-pump enclosure 20 is provided with a sound absorption media or material 182. It is noted that alternatively, a different enclosure could be utilized to form the exhaust plenum, such as a separate enclosure for that purpose, or a modified air-motor enclosure.

The liquid-pump enclosure 20 has an exhaust outlet 184 for providing fluid communication between the interior space or exhaust plenum 170 and the ambient air surrounding the liquid-pump enclosure 20. Preferably, there is not a straight path from the air outlet 44 to the exhaust outlet 184 so that the air contacts the sound absorption media 182 prior to exiting the exhaust plenum 170. The exhaust outlet 184 of the illustrated embodiment is a plurality of vertically elongated slots located on a lateral side of the liquid-pump enclosure 20, that is, a side of the enclosure 20 perpendicular to the air outlet 44 and parallel to a straight line path of air exiting the air outlet 44. Alternatively, a baffle can be located within the liquid pump enclosure 20 over the exhaust outlet 184.

Exhaust air passing through the exhaust plenum 170 from the air outlet 44 to the exhaust outlet 184 also serves to flow over and cool the high-pressure liquid-pump module 14, which is relatively hot compared to the exhaust air, located within the exhaust plenum 170. The exchange of heat between the exhaust air and the liquid-pump module 14 also serves to reduce freezing water vapor or ice build up at the air outlets 44.

Although particular embodiments of the invention have been described in detail, it will be understood that the invention is not limited correspondingly in scope, but includes all changes and modifications coming within the spirit and terms of the claims appended hereto.

What is claimed is:

1. An air-driven pump comprising:

an air motor including first and second bulkheads, a motor cylinder held between said first and second bulkheads, a motor piston within said motor cylinder, and an air control system for supplying air from an air inlet to said motor cylinder alternately on each side of said motor piston while venting said motor cylinder on an opposite side of said motor piston to an air outlet to reciprocate said motor piston in said motor cylinder, said first bulkhead having an opening substantially coaxial with said motor cylinder and first and second stepped recesses at an outward side of said first bulkhead which surround said opening, said second recess being laterally larger and longitudinally smaller than said first recess; and first and second fluid pumps interchangeably mountable to said first bulkhead of said fluid motor, each of said first and second fluid pumps including an end block, a pump cylinder held between said end block and said first bulkhead substantially coaxial with said motor cylinder and within one of said recesses, and a pump piston within said pump cylinder and removably connected to said motor piston through said opening for reciprocable movement of said pump piston with said motor piston, said pump cylinder of said first fluid pump being sized and shaped for cooperating with said first recess of said first bulkhead, and said pump cylinder of said second fluid pump being sized and shaped for cooperating with said second recess of said first bulkhead.

2. The air-driven pump according to claim 1, wherein said second bulkhead has an opening substantially coaxial with said motor cylinder and first and second stepped recesses at an outward side of said second bulkhead and surrounding said opening in said second bulkhead.

3. The air-driven pump according to claim 1, further comprising an enclosure forming an exhaust plenum in fluid communication with said air outlet and having an exhaust outlet.

4. The air-driven pump according to claim 3, wherein internal surfaces of said enclosure are provided with sound absorbing material.

5. The air-driven pump according to claim 3, wherein said first and second fluid pumps are interchangeably mountable to said first bulkhead within said exhaust plenum.

6. The air-driven pump according to claim 3, wherein said exhaust outlet is located on a side of said enclosure generally perpendicular to said air outlet.

7. The air-driven pump according to claim 1, further comprising a first enclosure substantially surrounding one of said first and second fluid pumps mounted to said first bulkhead.

8. The air-driven pump according to claim 7, further comprising a second enclosure substantially surrounding said air motor.

9. The air-driven pump according to claim 1, further comprising an enclosure substantially surrounding said air motor.

10. The air-driven pump according to claim 1, wherein said first bulkhead has a vent passage extending to a peripheral surface of said first recess.

11. The air-driven pump according to claim 1, wherein said first and second recesses are cylindrically-shaped.

12. An air-driven pump assembly comprising:

an air motor including first and second bulkheads, a motor cylinder between said first and s second bulkheads, a motor piston within said motor cylinder, and an air control system for supplying air from an air inlet to said motor cylinder alternately on each side of said motor piston while venting said motor cylinder on an opposite side of said motor piston to an air outlet at said first bulkhead to reciprocate said motor piston in said motor cylinder;

a fluid pump mounted to said first bulk head and operably connected to said air motor, said fluid pump including a pump cylinder, a pump piston within said pump cylinder and connected to said motor piston for reciprocable movement therewith; and a first enclosure engaging an outer side of said first bulkhead about said air outlet and, along with said first bulkhead, forming an exhaust plenum in fluid communication with said air outlet, said first enclosure having an exhaust outlet.

13. The air-driven pump according to claim 12, wherein internal surfaces of said first enclosure are provided with sound absorbing material.

14. The air-driven pump according to claim 12, wherein said fluid pump is located within said said first enclosure.

15. The air-driven pump according to claim 12, wherein said exhaust outlet is located on a side of said first enclosure generally perpendicular to said air outlet.

16. The air driven pump according to claim 14, further comprising a second enclosure substantially surrounding said air motor.

17. An air-driven pump comprising:

an air motor including first and second bulkheads, a motor cylinder between said first and second bulkheads, a motor piston within said motor cylinder, and an air control system for supplying air from an air inlet to said motor cylinder alternately on each side of said motor piston while venting said motor cylinder on an opposite side of said motor piston to an air outlet to reciprocate said motor piston in said motor cylinder;

a fluid pump mounted to said first bulkhead and operably connected to said air motor, said fluid pump including a pump cylinder, a pump piston within said pump cylinder and connected to said motor piston for reciprocable movement therewith;

a removable first enclosure substantially surrounding said fluid pump and, along with said first bulkhead, enclosing said fluid pump; and a removable second enclosure substantially surrounding said air motor and separate from said first enclosure.

18. The air-driven pump according to claim 17, wherein said first enclosure forms an exhaust plenum in fluid communication with said air outlet and has an exhaust outlet.

19. The air-driven pump according to claim 18, wherein internal surfaces of said first enclosure are provided with sound absorbing material.

20. The air-driven pump according to claim 18, wherein said exhaust outlet is located on a side of said first enclosure generally perpendicular to said air outlet.

* * * * *